US010806664B1

(12) United States Patent
Jan et al.

(10) Patent No.: US 10,806,664 B1
(45) Date of Patent: Oct. 20, 2020

(54) SPA SPRAYER

(71) Applicant: Foresee Scientech Ltd., Xiushui Township, Changhua County (TW)

(72) Inventors: Danny Jan, Xiushui Township (TW); Cheng-Hsiung Chang, Xiushui Township (TW)

(73) Assignee: Foresee Scientech Ltd., Xiushui Township (TW)

( * ) Notice: Subject to any disclaimer, the term of this patent is extended or adjusted under 35 U.S.C. 154(b) by 0 days.

(21) Appl. No.: 16/389,118

(22) Filed: Apr. 19, 2019

(51) Int. Cl.
*A61H 33/00* (2006.01)
*A47K 3/022* (2006.01)

(52) U.S. Cl.
CPC ..... *A61H 33/6042* (2013.01); *A47K 3/022* (2013.01); *A61H 33/6047* (2013.01)

(58) Field of Classification Search
CPC ..... A61H 33/6042; A61H 33/6047; A61H 35/006; A47K 3/022
USPC ..... 4/541.3, 541.6, 622; 417/420
See application file for complete search history.

(56) References Cited

U.S. PATENT DOCUMENTS

2009/0290992 A1* 11/2009 Long ..... A61H 33/6047 417/53
2014/0377100 A1* 12/2014 Le ..... F04D 29/047 417/420
2015/0040310 A1* 2/2015 Long ..... A47K 3/022 4/622

* cited by examiner

*Primary Examiner* — Tuan N Nguyen
(74) *Attorney, Agent, or Firm* — Alan D. Kamrath; Mayer & Williams PC

(57) ABSTRACT

A spa sprayer contains: a body and a water spray unit. The spray unit including a spraying seat, a lid, and a cavity defined between the spraying seat and the lid. The spraying seat is mounted on an end of the body away from the motor and has an impeller received in the cavity. The lid has at least one inlet and two opposite outlets which are in communication with the cavity. The lid further has a spacing rib, an inflow space formed inside the spacing rib, an outflow space formed outside the spacing rib, and multiple tilted guide ribs. A tilted direction of the multiple tilted guide ribs corresponds to a rotation direction of the impeller, each of the multiple tilted guide ribs has an oblique angle, and the lid further has two stop shoulders extending from the two opposite outlets.

7 Claims, 8 Drawing Sheets

SPA SPRAYER

BACKGROUND OF THE INVENTION

Field of the Invention

The present invention relates to a spa sprayer, and more particularly to the spa sprayer which supplies water into a foot spa tub forcefully.

Description of the Prior Art

A foot spa tub has a conventional spa sprayer mounted on a peripheral wall thereof, and water is sprayed out of the conventional spa sprayer after being drawn from the foot spa tub and being pressurized by the conventional spa sprayer. In addition, the water is swirled forcefully to enhance blood circulation and metabolism of feet of a user.

Referring to FIG. 8, a conventional spa sprayer contains: a body 80 and a water spray unit 90.

The body 80 includes a motor 81 and a fixing unit 82 connected with an end of the motor 81 and configured to fix the body 10 on a peripheral wall of a foot spa tub.

The water spray unit 90 includes a spraying seat 91, a lid 92 connected with the spraying seat 91, and a cavity 93 defined between the spraying seat 91 and the lid 92.

The spraying seat 91 is mounted on an end of the body 80 away from the motor 81, and the spraying seat 91 has an impeller 911 received in the cavity 93 and driven by the motor 81 to rotate. The lid 92 has at least one inlet 921 defined around a center thereof and has two opposite outlets 922 formed proximate to a peripheral side of the lid 92, wherein the at least one inlet 921 and the two opposite outlets 922 are in communication with the cavity 93.

In operation, the impeller 911 is driven by the motor 81 to rotate, by which water is drawn into the at least one inlet 921 of the lid 92 and is pressurized by the impeller 911 to spray out of the two opposite outlets 922 of the lid 92. However, the water is sprayed out of the two opposite outlets 922 in a small flow slowly, thus swirling the water in the foot spa tub poorly. The present invention has arisen to mitigate and/or obviate the afore-described disadvantages.

SUMMARY OF THE INVENTION

The primary objective of the present invention is to provide a spa sprayer which contains a spacing rib configured to reduce interface of water supply and discharge, and multiple tilted guide ribs radially extend to an outflow space from the spacing rib, such that when the spa sprayer sprays the water, the water in the outflow space is guided, accelerated, and pressurized by ways of the multiple tilted guide ribs and two stop shoulders to spray out of the two opposite outlets of the lid forcefully and rapidly, thus supplying and swirling the water in the foot spa tub to enhance user's blood circulation and metabolism.

A spa sprayer provided by the present invention contains: a body and a water spray unit.

The water spray unit includes a spraying seat and a lid connected with the spraying seat.

The spray unit further includes a cavity defined between the spraying seat and the lid, the spraying seat is mounted on an end of the body away from the motor, and the spraying seat has an impeller received in the cavity.

The lid has at least one inlet defined around a center thereof and has two opposite outlets formed proximate to a peripheral side of the lid, wherein the at least one inlet and the two opposite outlets are in communication with the cavity, the lid further has a spacing rib defined among the two opposite outlets and the at least one inlet and on a surface of the lid facing the cavity, an inflow space formed inside the spacing rib, an outflow space formed outside the spacing rib, and multiple tilted guide ribs radially extending to the outflow space from the spacing rib. A tilted direction of the multiple tilted guide ribs corresponds to a rotation direction of the impeller, each of the multiple tilted guide ribs has an oblique angle, and the lid further has two stop shoulders extending from the two opposite outlets corresponding to a rear portion of the rotation direction of the impeller.

DETAILED DESCRIPTION OF THE PREFERRED EMBODIMENTS

Figure 1:
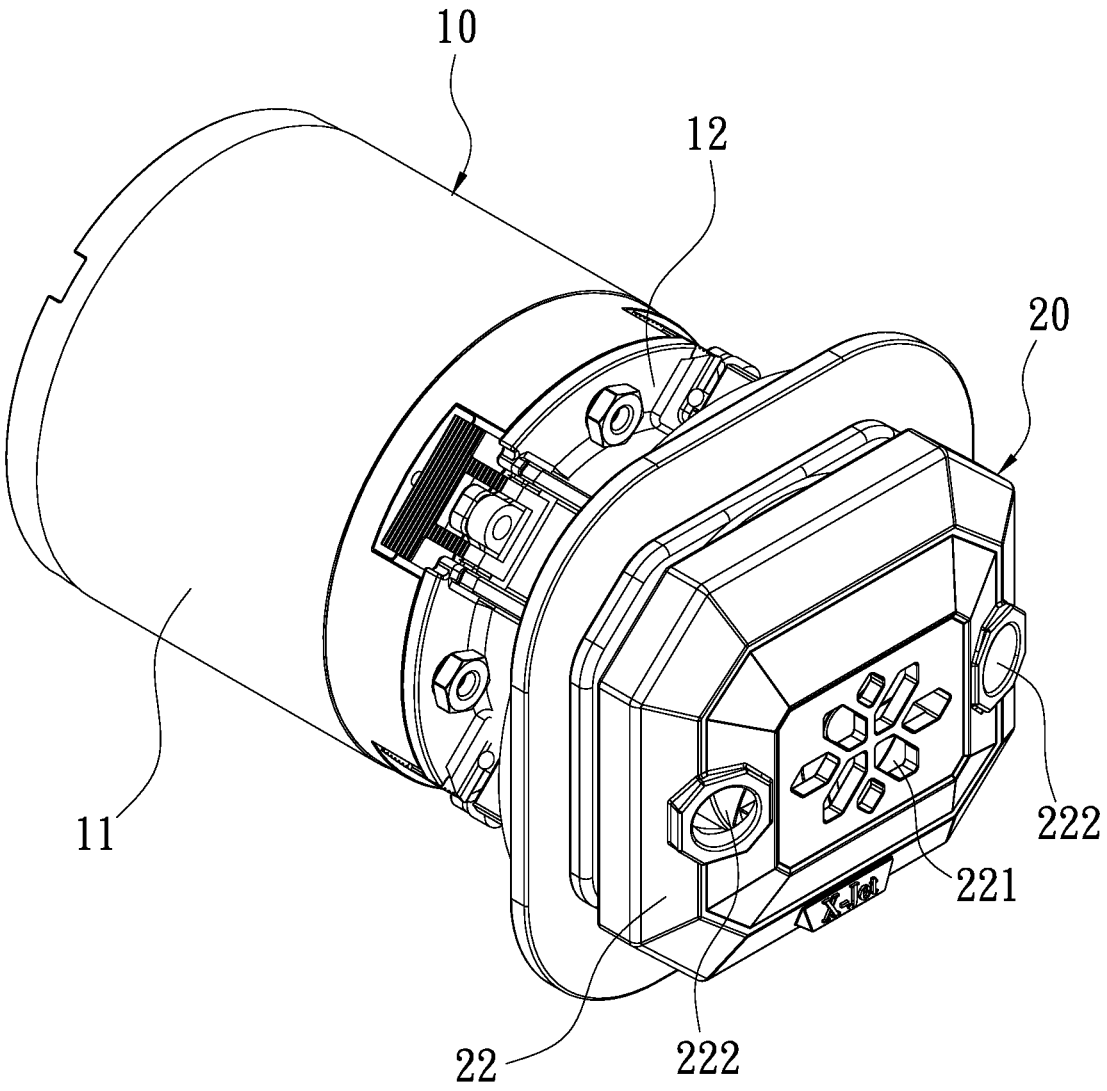
FIG. 1 is a perspective view showing the assembly of a spa sprayer according to a preferred embodiment of the present invention.
Figure 2:
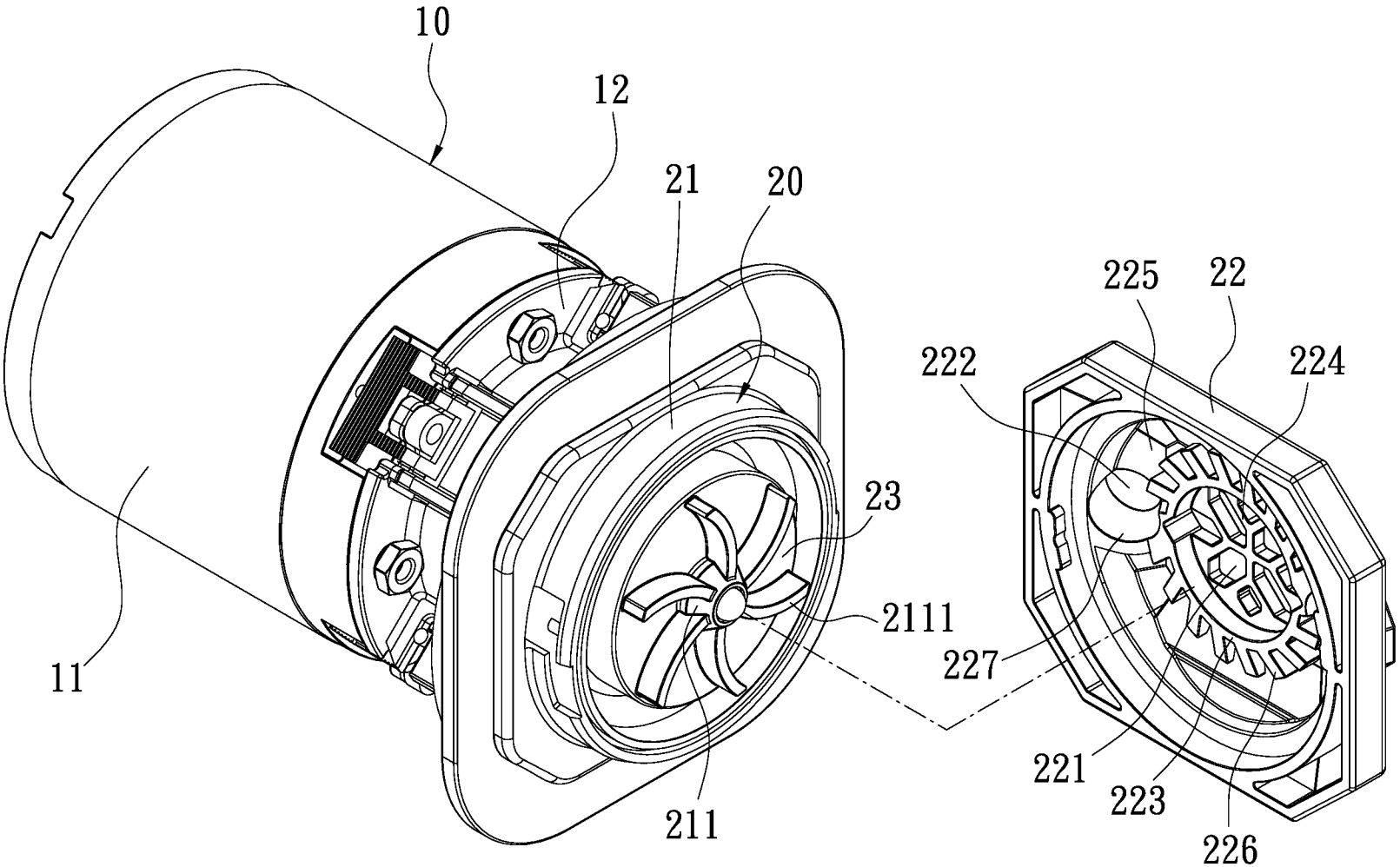
FIG. 2 is a perspective view showing the exploded components of the spa sprayer according to the preferred embodiment of the present invention.
Figure 3:
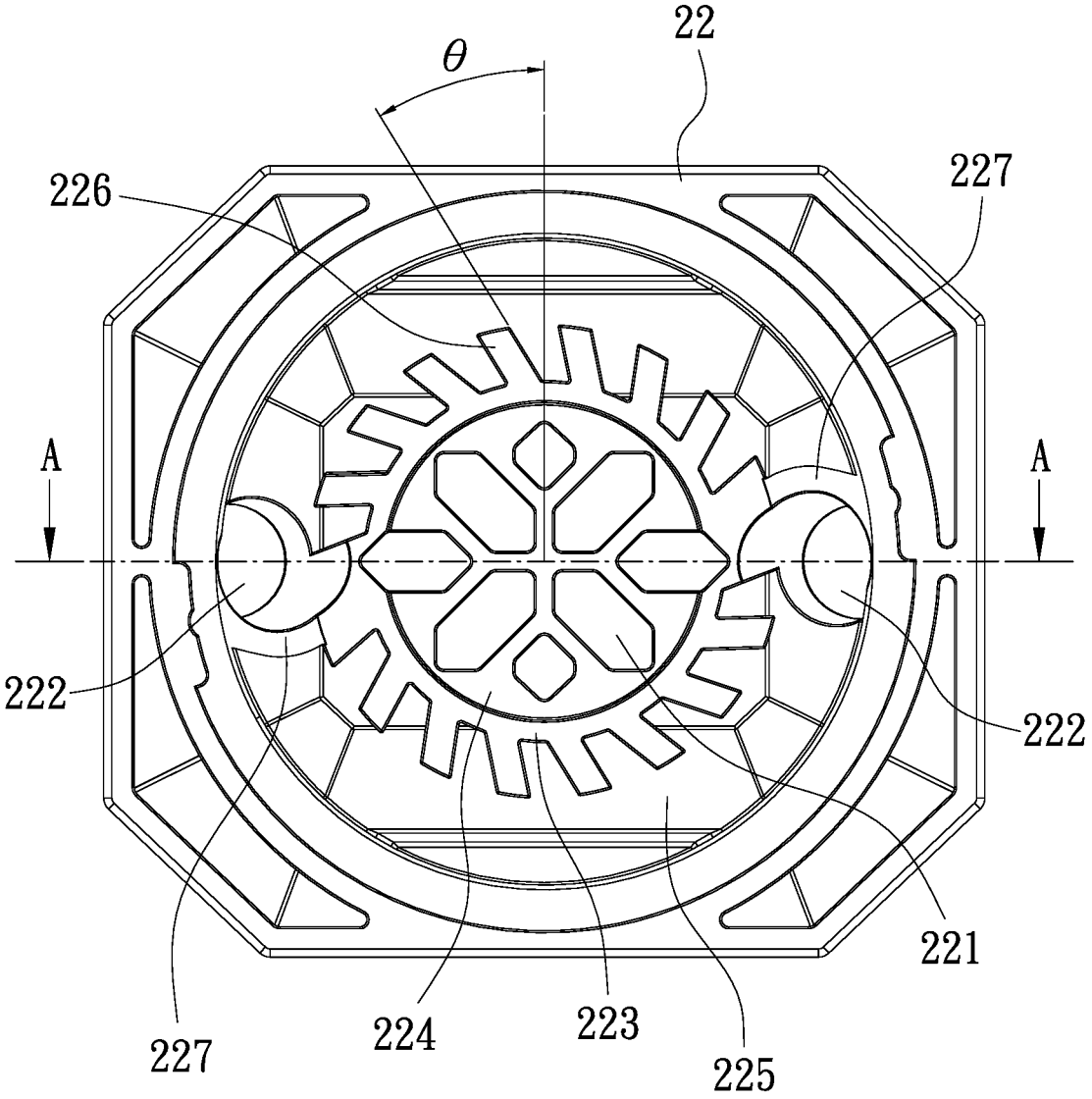
FIG. 3 is a side plan view showing the assembly of a part of the spa sprayer according to the preferred embodiment of the present invention.
Figure 4:
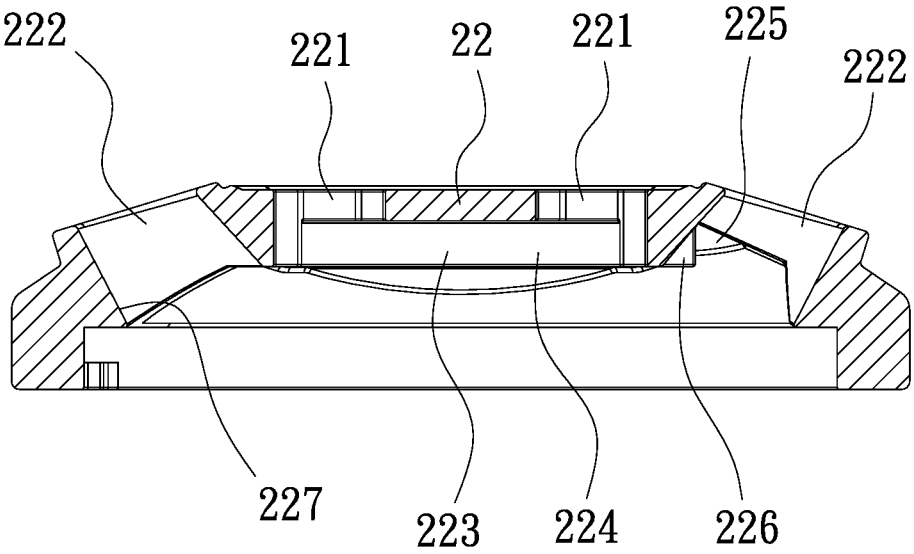
FIG. 4 is a cross sectional view taken the line A-A of FIG. 3.

The present invention will be clearer from the following description when viewed together with the accompanying drawings, which show, for purpose of illustrations only, a preferred embodiment in accordance with the present invention.

With reference to FIGS. 1-4, a spa sprayer according to a preferred embodiment of the present invention comprises a body 10 and a water spray unit 20.

The body 10 includes a motor 11 and a fixing unit 12 connected with an end of the motor 11 and configured to fix the body 10 on a peripheral wall of a foot spa tub.

The water spray unit 20 includes a spraying seat 21, a lid 22 connected with the spraying seat 21, and a cavity 23 defined between the spraying seat 21 and the lid 22.

The spraying seat 21 is mounted on an end of the body 10 away from the motor 11, and the spraying seat 21 has an impeller 211 received in the cavity 23 and driven by the motor 11 to rotate, and the impeller 211 has multiple blades 2111 extending radially along a rotation direction of the impeller 211 and formed in an arc shape.

The lid 22 has at least one inlet 221 defined around a center thereof and has two opposite outlets 222 formed proximate to a peripheral side of the lid 22, wherein the at least one inlet 221 and the two opposite outlets 222 are in communication with the cavity 23. The lid 22 further has a spacing rib 223 defined among the two opposite outlets 222 and the at least one inlet 221 and on a surface of the lid 22 facing the cavity 23, a inflow space 224 formed inside the spacing rib 223, an outflow space 225 formed outside the spacing rib 223, and multiple tilted guide ribs 226 radially extending to the outflow space 225 from the spacing rib 223, wherein a tilted direction of the multiple tilted guide ribs 226 corresponds to a rotation direction of the impeller 211, each of the multiple tilted guide ribs 226 has an oblique angle θ, and the oblique angle θ is within 20 degrees to 40 degrees (in this embodiment, the oblique angle θ is 30 degrees). The lid 22 further has two stop shoulders 227 extending from the two opposite outlets 222 corresponding to a rear portion of the rotation direction of the impeller 211.

Figure 5:
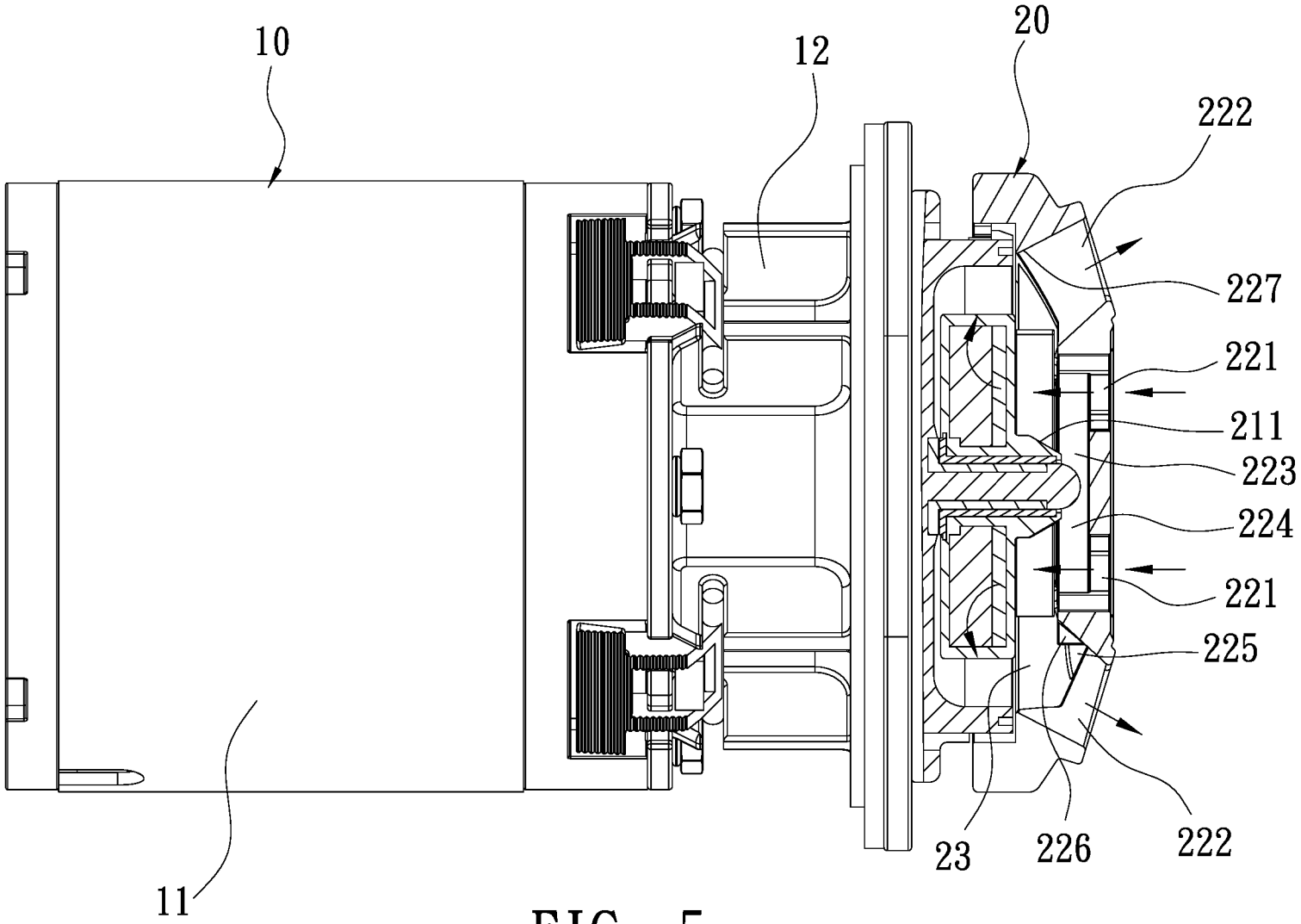
FIG. 5 is a cross sectional view showing the operation of the spa sprayer according to the preferred embodiment of the present invention.
Figure 6:
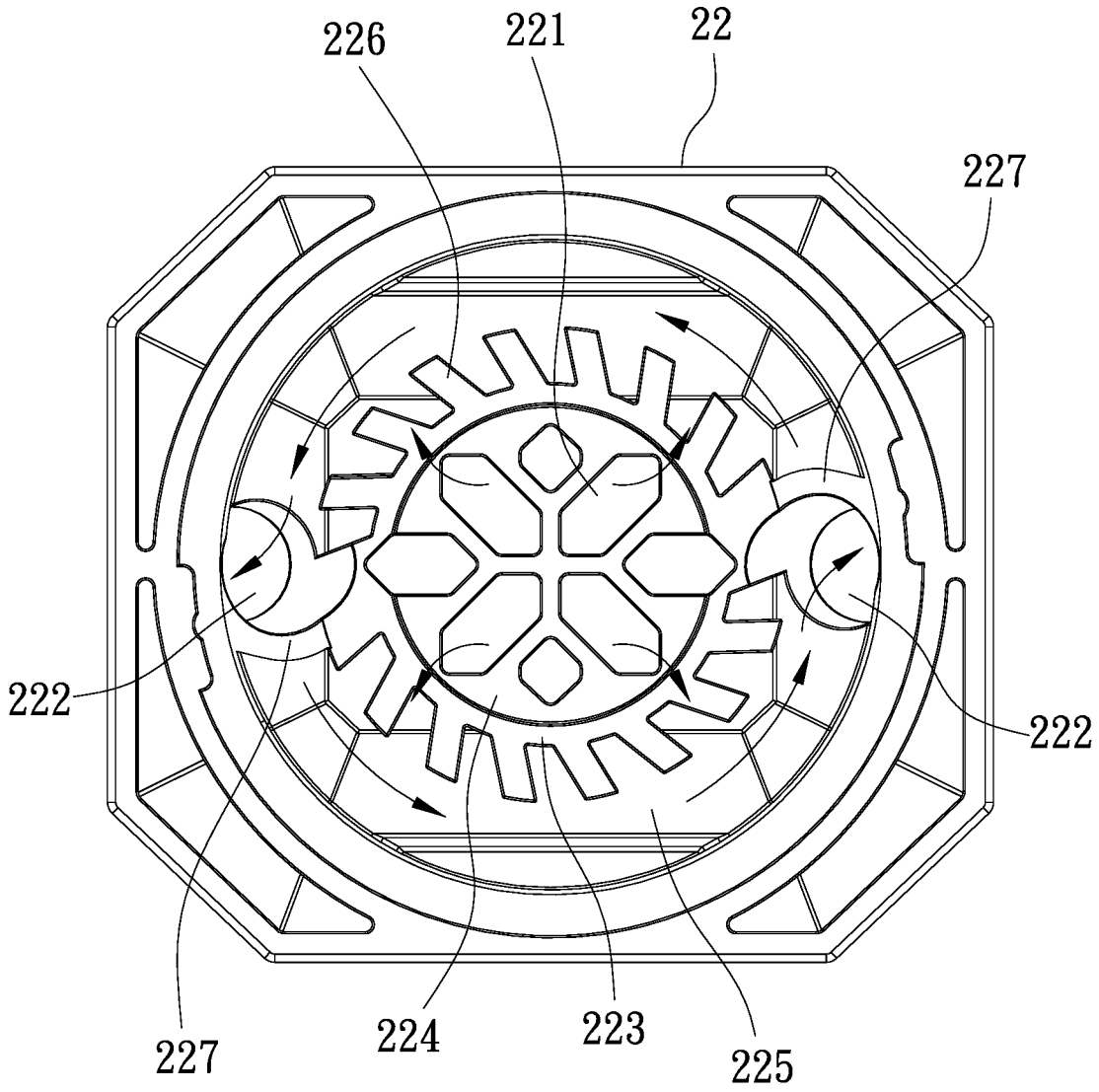
FIG. 6 is a side plan view showing the operation of the spa sprayer according to the preferred embodiment of the present invention.
Figure 7:
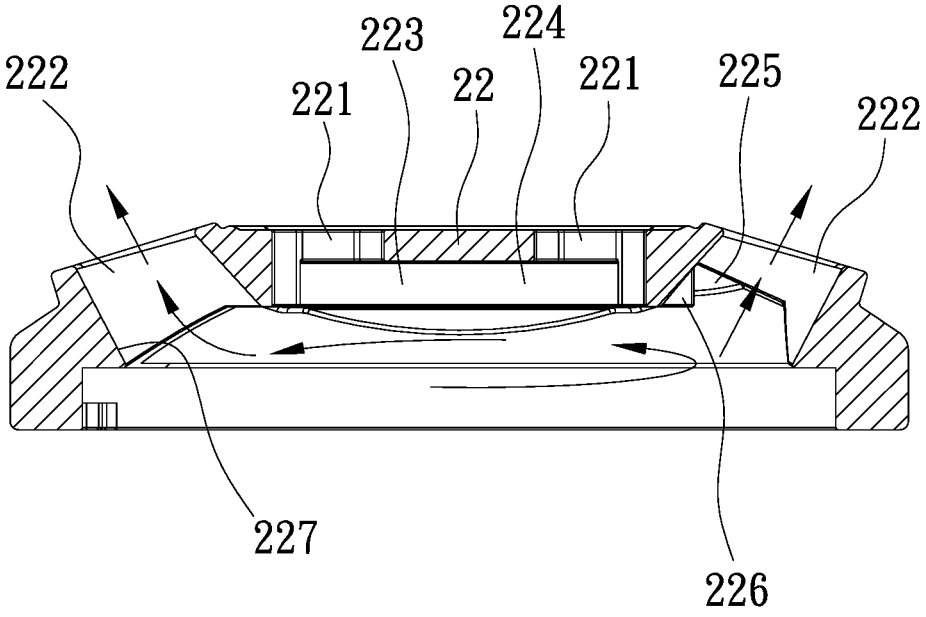
FIG. 7 is another cross sectional view showing the operation of the spa sprayer according to the preferred embodiment of the present invention.
Figure 8:
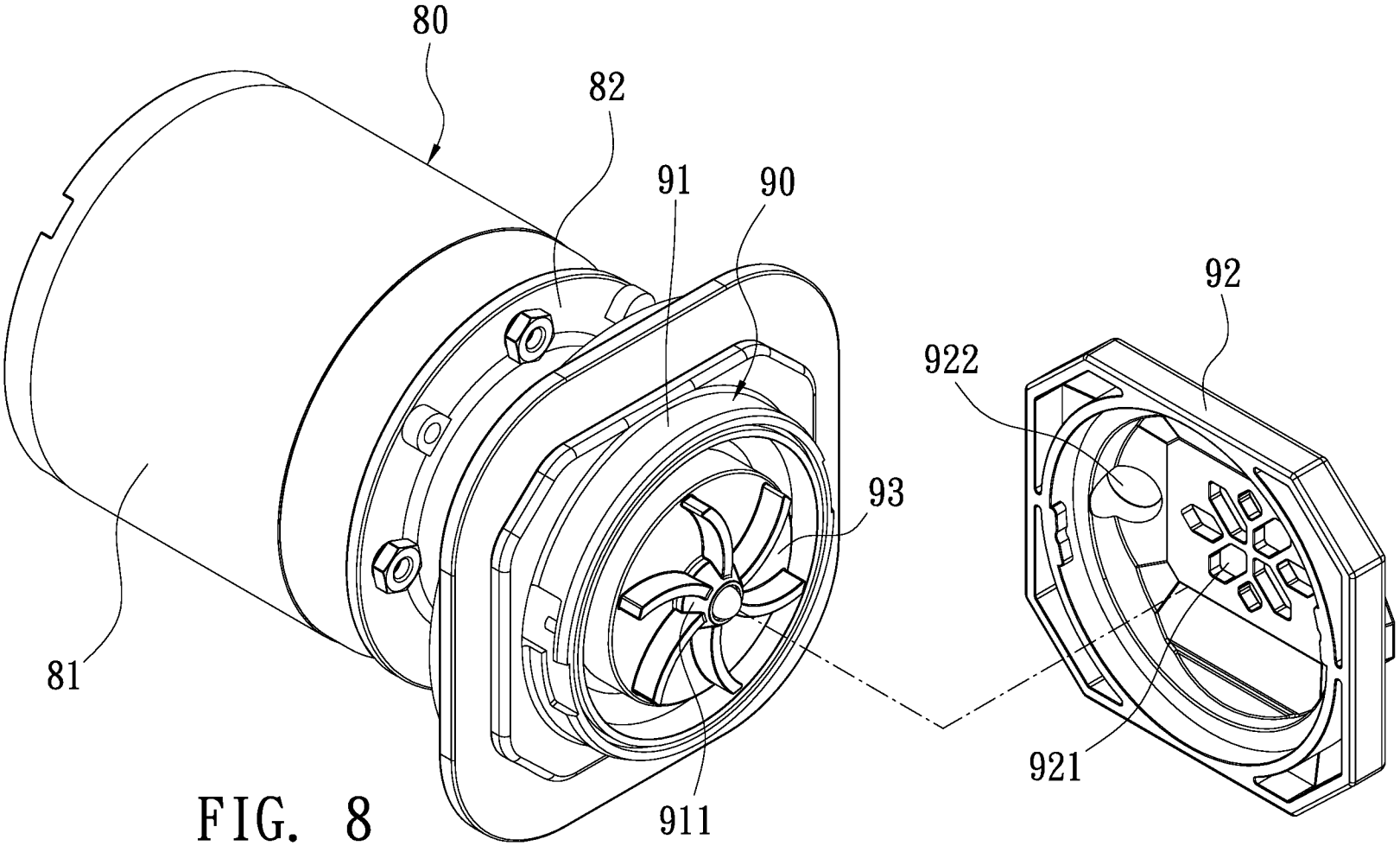
FIG. 8 PRIOR ART
FIG. 8 is a perspective view of a conventional spa sprayer.

Referring to FIGS. 5-7, the spa sprayer is mounted on the peripheral wall of the foot spa tub by using the fixing unit 12 of the body 10 so that the motor 11 of the body 10 drives the impeller 211 of the water spray unit 20 to rotate, and the impeller 211 rotates to draw water into the cavity 23 via the at least one inlet 221 and the inflow space 224. Thereafter, the water is pressurized by the impeller 211 to flow into the outflow space 225 of the lid 22, and the water in the outflow space 225 is guided, accelerated, and pressurized by ways of the multiple tilted guide ribs 226 and the two stop shoulders 227 to spray out of the two opposite outlets 222 of the lid 22 forcefully, thus supplying and swirling the water in the foot spa tub. Therefore, the spa sprayer has following advantages:

The lid 22 further has a spacing rib 223 by which the inflow space 224 and the outflow space 225 are spaced to reduce interface of water supply and discharge, and the multiple tilted guide ribs 226 radially extend to the outflow space 225 from the spacing rib 223, such that when the spa sprayer sprays the water, the water in the outflow space 225 is guided, accelerated, and pressurized by ways of the multiple tilted guide ribs 226 and the two stop shoulders 227 to spray out of the two opposite outlets 222 of the lid 22 forcefully and rapidly, thus supplying and swirling the water in the foot spa tub to enhance user's blood circulation and metabolism.

While various embodiments in accordance with the present invention have been shown and described, it is clear to those skilled in the art that further embodiments may be made without departing from the scope of the present invention.

What is claimed is:

1. A spa sprayer comprising:

a body; and a water spray unit including a spraying seat and a lid connected with the spraying seat;

wherein the spray unit further includes a cavity defined between the spraying seat and the lid, the spraying seat is mounted on an end of the body away from a motor, and the spraying seat has an impeller received in the cavity;

wherein the lid has at least one inlet defined around a center thereof and has two opposite outlets formed proximate to a peripheral side of the lid, wherein a at least one inlet and the two opposite outlets are in communication with the cavity, the lid further has a spacing rib defined among the two opposite outlets and the at least one inlet and on a surface of the lid facing the cavity, an inflow space formed inside the spacing rib, an outflow space formed outside the spacing rib, and multiple tilted guide ribs radially extending to the outflow space from the spacing rib, wherein a tilted direction of the multiple tilted guide ribs corresponds to a rotation direction of the impeller, each of the multiple tilted guide ribs has an oblique angle, and the lid further has two stop shoulders extending from the two opposite outlets corresponding to a rear portion of the rotation direction of the impeller.

2. The spa sprayer as claimed in claim 1, wherein the body includes the motor and a fixing unit connected with an end of the motor and configured to fix the body on a peripheral wall of a foot spa tub, wherein the impeller is driven by the motor to rotate.

3. The spa sprayer as claimed in claim 1, wherein the impeller has multiple blades extending radially along a rotation direction of the impeller and formed in an arc shape.

4. The spa sprayer as claimed in claim 1, wherein the inflow space is circular.

5. The spa sprayer as claimed in claim 1, wherein the outflow space is annular.

6. The spa sprayer as claimed in claim 1, wherein the oblique angle is within 20 degrees to 40 degrees.

7. The spa sprayer as claimed in claim 6, wherein the oblique angle is 30 degrees.

* * * * *